US009131736B2

(12) United States Patent
Muche et al.

(10) Patent No.: US 9,131,736 B2
(45) Date of Patent: Sep. 15, 2015

(54) MEDICAL CLOTHING ITEM

(75) Inventors: Marion Muche, Heidenheim (DE); Uwe Nagy, Heidenheim (DE)

(73) Assignee: PAUL HARTMANN AG, Heidenheim (DE)

( * ) Notice: Subject to any disclaimer, the term of this patent is extended or adjusted under 35 U.S.C. 154(b) by 220 days.

(21) Appl. No.: 13/805,246

(22) PCT Filed: Jun. 10, 2011

(86) PCT No.: PCT/EP2011/059671

§ 371 (c)(1),
(2), (4) Date: Dec. 18, 2012

(87) PCT Pub. No.: WO2011/157644

PCT Pub. Date: Dec. 22, 2011

(65) Prior Publication Data

US 2013/0091616 A1 Apr. 18, 2013

(30) Foreign Application Priority Data

Jun. 18, 2010 (DE) ..... 10 2010 024 918

(51) Int. Cl.
*A41D 13/00* (2006.01)
*A41D 13/12* (2006.01)

(52) U.S. Cl.
CPC ..... *A41D 13/1209* (2013.01); *A41D 13/1236* (2013.01); *A41D 2300/32* (2013.01)

(58) Field of Classification Search
CPC ..... A41D 2300/30; A41D 2300/32; A41D 2300/326; A41D 2400/42; A41B 7/00; A41B 7/02; A41B 7/04; A41B 7/06; A41B 9/008; A41B 2300/30; A41B 2300/32; A41B 2300/328; A41B 2300/332; A41F 1/00; A41F 1/04; A41F 1/06; A41F 1/08; A41F 1/006
See application file for complete search history.

(56) References Cited

U.S. PATENT DOCUMENTS

| | | | | |
|---|---|---|---|---|
| 3,359,569 | A | 12/1967 | Rotanz et al. | |
| 3,824,625 | A * | 7/1974 | Green | 2/114 |
| 4,718,124 | A * | 1/1988 | Sawicki et al. | 2/114 |
| 5,184,351 | A * | 2/1993 | Benstock | 2/114 |

(Continued)

FOREIGN PATENT DOCUMENTS

| | | |
|---|---|---|
| CN | 1228275 | 9/1999 |
| CN | 101528174 | 9/2009 |

(Continued)

*Primary Examiner* — Gloria Hale
(74) *Attorney, Agent, or Firm* — Henry M. Feiereisen LLC.

(57) ABSTRACT

A medical clothing item, includes a body covering section having first and second side edges delimiting an opening of the body covering section and at least one closure for closing the opening, wherein the closure includes a first closure element arranged on the first side edge, and a second closure element, arranged on the second side edge and/or in a region bordering the second side edge, wherein the first closure element has a fastening section for permanent fastening on the body covering section, a release section non-detachably connected with the body covering section, and a coupling section connected with the fastening section, wherein the coupling section is coverable when not interacting with the second closure element, wherein the coupling section has first mechanical coupling means for coupling to the second closure element, wherein the second closure element has second mechanical coupling means formed by a surface of the medical clothing item.

18 Claims, 7 Drawing Sheets

(56) References Cited

U.S. PATENT DOCUMENTS

| | | | | |
|---|---|---|---|---|
| 5,414,867 | A * | 5/1995 | Bowling et al. | 2/51 |
| 5,652,962 | A * | 8/1997 | Patnode | 2/114 |
| 6,138,278 | A | 10/2000 | Taylor et al. | |
| 6,235,659 | B1 | 5/2001 | McAmish et al. | |
| 2005/0061331 | A1 | 3/2005 | Cheung | |
| 2005/0132465 | A1 | 6/2005 | Kathumbi-Jackson et al. | |
| 2008/0097368 | A1 | 4/2008 | Molander | |

FOREIGN PATENT DOCUMENTS

| | | |
|---|---|---|
| DE | 102 50 275 | 5/2004 |
| DE | 102004024590 | 12/2005 |
| EP | 0 920 847 | 6/1999 |
| WO | WO 01/67912 | 9/2001 |

* cited by examiner

MEDICAL CLOTHING ITEM

CROSS-REFERENCES TO RELATED APPLICATIONS

This application is the U.S. National Stage of International Application No. PCT/EP2011/059671, filed Jun. 10, 2011, which designated the United States and has been published as International Publication No. WO 2011/157644 A1 and which claims the priority of German Patent Application, Serial No. 10 2010 024 918.1, filed Jun. 18, 2010, pursuant to 35 U.S.C. 119(a)-(d).

BACKGROUND OF THE INVENTION

The invention relates to a medical clothing item, in particular a surgical gown or examination gown having a body covering section and sleeves adjoining the body covering section, wherein the body covering section has an opening for putting on the medical clothing item and at least one closure for closing the opening, wherein the closure has a first closure element on a first side edge of the body covering section which delimits the opening, and a second closure element which is arranged at a second side edge of the body covering section which delimits the opening, and/or in a region which borders at a second side edge of the body covering section which delimits the opening. The second side edge of the body covering section opposes the first side edge with regard to the opening. This means the one first side edge delimits the opening on the first side and the second side edge delimits the opening on a second side. The opening and the side edges extend in longitudinal direction or in a direction of wear of the body covering section or the clothing item.

Such a medical clothing item can be in particular a disposable clothing item which can alternatively also be used in the biological and chemical field. Such clothing items include as body covering section usually a front side and a back side, wherein the back side is often formed by a first and a second back part, which border at the opening and which include side edges for delimiting the opening.

The opening can be configured so that the first and second side edges which delimit the opening are arranged so as to overlap with each other when the clothing item is worn or the side edges can be arranged to abut each other or so as to from a small gap between one another when worn.

SUMMARY OF THE INVENTION

Such clothing items are in particular examination gowns or surgical gowns. Medical clothing items within the meaning of the invention have a broad range of applications in the entire medical field, such as in particular as clothing items for medical doctors during the medical examination, during ward rounds or during surgery etc. such in particular disposable clothing items which an also be referred to as surgical coat or as surgical gown, serve for protecting the wearer, in particular the surgeon, against liquids and/or microorganisms which are occur during a treatment in particular a surgery of a patient. Surgeons and other personnel working in the medical field mostly wear over clothing items, so called surgical coats or surgical gowns which in the following is used synonymously, during surgery but also during other activities in the medical environment such as for example for medical examinations, during rounds, in order on one hand to improve sterility but also in order to protect the underlying clothing of the wearer.

Such clothing items are often produced from a particularly breathable non woven fabric and are intended as disposable articles.

Such clothing items, when configured as tieable gowns, are usually put on with the aid of closure elements, provided on the clothing items mostly in the form of closure straps which initially extend in the region of the front part and are held there with their end sections on a loop (transfer card). The ends of the closure elements can be fastened on the two back parts, in particular at the height of the waist or the stomach. Typically, when the gown is put on, a further member of the medical staff grasps the loop, whereby the closure elements are released from the loop. By rotating the wearer of the clothing item, the closure elements can then be guided around the wearer and in this way close the clothing item in a manner so as to be able to ensure in particular an overlap of the back parts and with this a secure fit of the clothing item during surgery.

Such a disposable clothing item, in particular for the medical, chemical and biotechnological field for protection against liquids and microorganisms is for example known from DE 102 50 275 A1.

A disadvantage of such clothing items for this field is that the clothing items have to be well closed in the region of the back of the neck around the neck and for this usually a closure at the neck line near the back of the neck with a first and a second closure element is provided. The closure can either be formed by additional tying straps wherein however, the provision of tying straps in the back of the neck is comparatively laborious, because these have to be closed with a loop by a third person. As an alternative, hook and loop closure elements or coupling elements can be provided in the neck area which fix the neck line in its shape after overlapping of the back parts. A disadvantage in this case is the risk that hairs become trapped in the hook and loop or adhesive closure elements. A disadvantage is also that, for example in case of a hook and loop closure element, the first part of the hook and loop closure element which is arranged on the one side edge, namely the hook part, becomes entangled with further elements or other clothing items of the wearer. To avoid this, a cover has to be provided on the hook and loop element which then has to be removed for use. The same applies analogously for coupling elements which in the unused state are normally covered by a detachable release material. It is further negative that by providing a second closure element on which the first closure element is anchored, wherein the second closure element is arranged as additional element on the body covering section, a further stiffening of the clothing item occurs in this region in particular in the neck region and the region of the back of the neck, and on the other hand the local arrangement of the separate second closure element does not allow an individual, infinitely variable closing of the opening, in particular does not allow an infinitely variable individual adjustment of the neck circumference of the clothing item.

Thus, EP 0 920 819 B1 describes a medical clothing item with an adhesive closure system, wherein in particular a removable release element is to be provided on the closure element, wherein the removable release element is configured to enable a sterile closing of the medical clothing item.

The object of the invention is to provide an improved closure for a medical clothing item for closing an opening, in particular an opening in longitudinal direction at the height of the neck region and the region of the back of the neck in which detachable release sections are not required, and wherein any desired adjustment of the closure to the wearer is possible.

The invention solves the object with a medical clothing item, including a body covering section having an inside and an outside, and first and second side edges delimiting an opening of the body covering section for putting on the medical clothing item, sleeves attached to the body covering section and at least one closure for closing the opening, wherein the closure includes a first closure element arranged on the first side edge, and a second closure element, arranged on the second side edge and/or in a region bordering the second side edge, wherein the first closure element has a fastening section for permanent fastening on the body covering section, a release section non-detachably connected with the body covering section, and an coupling section connected with the fastening section, wherein the coupling section is coverable when not interacting with the second closure element, wherein the coupling section has first mechanical coupling means for coupling to the second closure element, and wherein the second closure element has second mechanical coupling means formed by a surface of the medical clothing item.

The first closure element has a fastening section for permanent fastening on the body covering section, a release section which is non-detachably connected with the fastening section, and a coupling section which is non-detachably connected to the fastening section and which can be covered when not interacting with the second closure element, wherein the coupling section bears first mechanical coupling means and the second closure element serves for adhesion of the first mechanical coupling means of the first closure element, wherein the second closure element has second mechanical coupling means which are formed by the surface of the medical clothing item.

Such a configuration has in particular the advantage that the release section is fixedly connected with the fastening section of the closure element, i.e., it is not severed from the closure element and does thus not have to be separately disposed of.

In a medical clothing item according to the invention with closure, the first closure element is thus non-detachably fastened to a side edge of the body covering section in that its fastening section and its release section are non-detachably connected with the body covering section, and in that the release section is further detachably connected with the fastening section.

In addition, an embodiment in which the second coupling means are formed by the surface of the medical clothing item has the advantage that no stiffening occurs by a so called landing zone which would have to be provided for the first coupling means and represents one further material component.

In addition, it can be in particular provided that by using the surface as second mechanical coupling means, any desired adjustability is given because the first mechanical coupling means can be adhered on the surface of the medical clothing item as second mechanical coupling means in any desired manner.

In particular, so called hook and loop or Velcro elements can be provided as mechanical coupling means. These include a hook element as first mechanical coupling means and an associated loop element as second mechanical coupling means in that the hooks of the hook element are anchored in the loops.

The hook/loop elements are also referred to as bur hook/bur fleece elements or as Hook/Loop elements.

The medical clothing item can in particular be a disposable clothing item, in particular a disposable surgery coat or a disposable examination coat.

The medical clothing item can alternatively also be used for the chemical or biological field.

The medical clothing item is preferably sterilizable. The medical clothing item is preferably provided as sterile medical clothing item.

The body covering section of the medical clothing item has a front side and a back side, wherein the opening of the body covering section is arranged on the front side and/or the backside.

BRIEF DESCRIPTION OF THE DRAWING

The front side or back side relates to the side which when wearing the clothing item is oriented ventral or dorsal.

In particular, the body covering section is formed by a front side in particular by a closed, particularly one-piece front part, and the back side is formed by a first and a second back part, which border at the opening and embrace the side edges for delimiting the opening. The back parts can be either connected one-piece with the front part or attached to the latter by sewing, bonding or welding processes and other processes.

Figure 1:
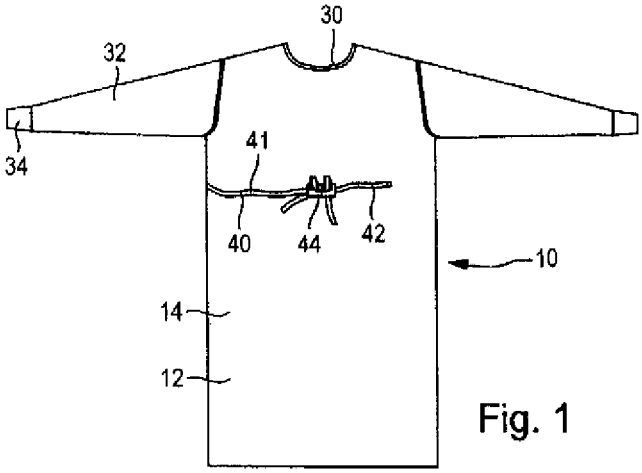

As already explained before, the opening and the side edges extend in longitudinal direction or direction of wear of the body covering section or the clothing item.

Within the context of the invention, the longitudinal direction or direction of wear relates to the direction assumed when the clothing item is used, namely the direction along the longitudinal axis of a wearer of the clothing item who stands upright. The transverse direction is the direction perpendicular to the longitudinal direction. Oblique to the longitudinal direction is any course that has an incline, i.e., any course extending at an angle different from 90° relative to the longitudinal direction. Oblique to the transverse direction is any course with an incline, i.e., at an angle different from 90° relative to the transverse direction. The inside is referred to as the surface of the body covering section or the clothing item which faces toward the wearer, the outside as the surface of the body covering section or clothing item which faces away from the wearer.

The opening can be configured that when the medical clothing item is worn, the first and second side edges which delimit the opening are arranged so as to overlap with each other or so as to abut each other or to form a slight gap between each other.

DETAILED DESCRIPTION OF PREFERRED EMBODIMENTS

The opening and the associated side edges extend over at least a portion of the longitudinal direction of the body covering section or the clothing item. The opening extends, in particular starting from an upper border of the body covering section or the clothing item, over a portion of the longitudinal direction, in particular starting from the upper border over the entire extent in longitudinal direction of the body covering section or the clothing item.

The upper border relates to a border which extends obliquely or perpendicularly to the longitudinal direction and which extends at the upper end of the body covering section or the clothing item.

The term "upper end" or "lower end" relates here always to the arrangement of the clothing item when in use at wearer who stands upright, i.e., "up" in the direction of the neck and "down" in the direction of the foot.

In particular, the closure in particular the first closure element can be arranged on and/or bordering an upper edge of the body covering section of the medical clothing item.

With this, the closure in particular the first closure element is arranged in the region of the neck of a wearer of the medical clothing item, or in particular the back of the neck of the wearer, i.e. a neck-/or back of the neck closure. Further closures, in particular in the configuration of the closure according to the invention and/or tying elements can additionally be provided on or bordering side edges which delimit the opening along the longitudinal direction of the medical clothing item, for example in the region of the waist of the medical clothing item. The closure according to the invention is essentially arranged in the region of the back of a wearer. When providing a neck or back of the neck closure, a certain distance to the upper edge of the body covering section can be provided.

The distance can be selected so that the first closure element does not come into contact with the skin of the wearer; but at the same time the clothing item can be closed at the neck itself. The distance to the upper edge is in particular at most 20 mm, further in particular at most 15 mm, further in particular at most 10 mm.

Beside the primary function as a closure for the opening, the first closure element can in particular also have a secondary function. The clothing item is usually stripped off after use so that it is turned inside out so that the inside of the clothing item faces toward the outside. Then, the clothing item is rolled up so that it assumes as small a size as possible and in particular contaminations on the outside of the clothing items remain enclosed in the inside of the rolled-up clothing item. The first closure element can then serve for fixing the rolled up clothing item. In particular, it is provided that the coupling section of the first closure element adheres to the material which forms the inside of the body covering section or the clothing item.

The first closure element has an essentially Y shaped configuration owing to the three sections, namely fastening section, release section and coupling section. The fastening section and coupling section extend in longitudinal direction of the closure element adjoining one another, wherein the release section entirely or partially covers the coupling section. The release section is also connected to the fastening section. The fastening section thus forms in a Y shaped configuration the lower end of the Y, whereas the release section and the coupling section form the two V shaped spread apart regions of the Y.

Longitudinal direction of the first closure element relates to the direction in which the release section adjoins the fastening section. This means the border between the release section and fastening section extends in transverse direction of the closure element. Preferably, the coupling section can also adjoin the fastening section in the longitudinal direction of the closure element. The longitudinal direction of the closure element extends preferably in the transverse direction of the clothing item or the body covering section. However, it can also be provided that the longitudinal direction of the closure element is arranged obliquely to the longitudinal or transverse direction of the clothing item or the body covering section.

In particular closing straps or tying straps can be provided on the back parts of the body covering section in the region of the hip or waist or the stomach region which are partially arranged at the side edges of the body covering section. These closure straps can serve for closing the clothing item in a conventional manner and in particular be fixed on a transfer card, from which the straps can then be removed when putting on the clothing item so that a second person helps the individual who is putting on the clothing item in that the straps are held and the wearer turns around her own axis.

Further, the sleeves which are arranged at the body covering section can have cuffs at their lower end which is not connected to the body covering section, wherein the cuffs can in particular have separate openings for the thumbs beside the openings for the hands. This allows achieving that the sleeves cannot not inadvertently be stripped upwards in the direction of the elbows but remain securely fixed below in the region of the hands. The cuffs can then at any time be covered by gloves so that a most extensive sterility can be achieved.

Further an additional element can be provided on one of the side edges of the body covering section which delimit the opening, which element starting from the upper border extends over at least a portion of the side edge which delimits the opening, wherein the additional element can serve for ensuring a greater overlap in the neck region.

A surface of the clothing item or the body covering section in particular the outside includes in particular a non woven material or is made of the latter.

In particular, the clothing item includes a non woven material as outer layer. In addition reinforcement materials can be provided at least in partial areas preferably on the front side and/or in the region of the sleeves, which reinforcement elements can in particular be formed by a non woven/film laminate. This allows achieving increasing the barrier effect in regions which are particularly encumbered with fluid and/or microorganisms. The reinforcement materials are preferably arranged on the inside of the clothing item. In particular in a nonwoven/film material the film can be configured breathable, for example by using a polypropylene or polyethylene film, into which a filling material for example calcium carbonate is introduced so that micro-pores are achieved by stretching the film.

As nonwoven material for the inside and/or outside and/or for the outer layer of the clothing item and/or as non woven material component in the non woven-/film laminate, a Spundbond (S)—and/or meltblown (M) non woven or laminates made from Spunbond and/or meltblown non woven layers or in particular laminates from Spundbond and meltblown non woven layers, such as in particular SM, SMS, SMMS or SMMMS are preferably used. The material can have different properties depending on whether and in which combination if applicable, Spundbond and meltblown layers are included in a laminate. Particularly preferably the non woven material is formed by polyethylene and/or polypropylene or from mixtures of the same as main components. Particularly preferably the non woven material has a surface weight of in particular 10-70 g/m$^2$, further in particular of 20-60 g/m$^2$, particularly preferably of 25-50 g/m$^2$.

The lamination of the non woven-/film laminate can occur in any way, preferably non wovens and films are connected by means of thermo-bonding and/or adhesive, in particular hot-melt adhesive, particularly preferably the thermo connected non woven/film laminates are used.

Further the clothing item can include a longitudinal adjustment. This has the advantage that an adjustment of the length of the clothing item to the wearer can occur. This can for example be realized in that a region of the clothing item can be folded up or down along a circumferentially extending fold line and fixed in this position, for example via bands adhesive or cohesive adhesion means or hook and loop elements.

Preferably a first surface of the release section is non-detachably and permanently connected with the body covering section and the second surface of the release section is detachably covered by the coupling section.

Further the coupling section can adjoin the fastening section in longitudinal direction of the first closure element. The release section is connected to the body covering section.

In particular, the first closure element is arranged at the first side edge which delimits the opening in such a manner that the longitudinal direction of the closure element extends perpendicularly or obliquely to the longitudinal direction of the body covering section or the clothing item.

In the closure element, the fastening section and the coupling section but also as alternative the fastening and the release section can be connected to each other integrally in particular one-piece.

In particular, the fastening section can be arranged on the outside of the body covering section in the position of use and the release section on the inside of the body covering section. The first closure element is folded about the first side edge, which delimits the opening so that a folding line results at the transition from the fastening section to the release section or coupling section. As an alternative, it can also be provided that the fastening section is slightly guided around the side edge so that the folding line is located within the fastening section. The coupling section which covers the release section is essentially arranged on the inside of the body covering section or the clothing item. As an alternative, a small region of the coupling section with which the latter is fastened on the fastening section can also extend on the outside of the body covering section or the clothing item.

Due to the fact that the coupling section of the first closure element in a state in which it is then fixed on the second closure element, is located outside of the side edge of the body covering section, thus forming an outside of the clothing item or the body covering section, a joint function between the coupling section and the body covering element is provided, whereby the freedom of movement of the wearer of the clothing item which closes the opening can be further improved.

In addition, it can be preferably provided that the coupling section has a handling section at is free end. The handling section can be formed cue to the coupling section not adhering on the release section or by being provided with a non adhesive region or layer and/or in that the coupling section protrudes over the release section with its free end.

Particularly preferably, the coupling section in addition to the first mechanical coupling means can have second adhesive coupling means. These adhesive coupling means serve for fixing the coupling section on the release section. In this case, a film can in particular be used as release section on which the first mechanical coupling means cannot adhere so that in the unused state of the closure, a fastening of the coupling section on the release section has to occur in a different manner. This can in particular be realized via an adhesive fixing via second adhesive coupling means. Particularly preferably, it can in addition be provided that first mechanical coupling means are arranged in longitudinal direction of the coupling element between second adhesive coupling means on the coupling section.

The adhesive coupling means additionally contribute to the fixing in addition to the mechanical coupling means.

As adhesive coupling means, preferably pressure sensitive adhesives in particular melt adhesives are used.

By fixing the coupling section on the release section, the first mechanical coupling means in particular hook elements and the second adhesive coupling means in particular the surfaces of the adhesive can be protected against contamination prior to use which would otherwise result in a poorer adhesive performance. Further, no hairs can become trapped on the coupling section in the neck area prior to the use of the coupling section.

As a result of the combination of different adhesive means, different adhesive states can be realized.

The used non woven materials for a surface, in particular for the outside of the body covering section have the advantage that on one hand mechanical coupling means such as hook and loop closures and here in particular the hook element of the hook and loop closure can adhere on the non woven material as second closure element. At the same time such a non woven material has the advantage that a certain adherability for adhesive is provided which in general adheres better on a surface which is as smooth as possible. This securement against detachment and shearing off of the adhesive means can be achieved via a closure system with a first closure element which includes adhesive as well as mechanical portions, and which can interact with a non woven material as second closure element and has a sufficient closure force. The non woven material as second closure element is particularly cost effective, because a separate closure element is not required, wherein at the same time a pleasant haptic of the clothing item is retained.

Particularly preferably, it can be provided that the first mechanical adhesion means are arranged so as to extend strip-shaped transverse to the longitudinal direction of the first closure element, i.e., to the coupling section. This allows achieving a certain flexibility of the coupling section and a higher rigidity of the closure, because each strip provides a first adhesive force which has to be overcome first during detachment.

In particular, regions without adhesive means and/or regions with second adhesive coupling means are provided between the strip shaped regions of the first mechanical coupling means. The supplementation with adhesive coupling means is in particular advantageous for increasing the adhesive force or also its action as explained before.

Particularly preferably, the first mechanical coupling means are configured mushroom like, i.e. with a hook stalk and with a hook head adjoining the hook stalk.

The height of the mechanical coupling means relative to the area surrounding the adhesive means can be between 0.20-0.80 mm, in particular between 0.20-0.70 mm and particularly preferably between 0.20-0.50 mm. The dimensions of the hook head are preferably between 100-500 μm, in particular between 150-400 μm, and particularly preferably between 150-300 μm, wherein here the dimension relates to the averaged distance between the borders of the circumference of the hook head. The hook heads preferably have a round or hexagonal area. Preferably, 200-300 of such hook heads are present per $cm^2$.

By means of these relatively fine mechanical coupling means an adhering in the fine loops of the non woven material can be provided so that good adhesive forces can be achieved when not including a separate loop element as touch down zone.

Particularly preferably, a hook element Mikroplastâ of the company Gottlieb Binder GmbH & Co. KG, Holsgerlingen Germany, is used, in particular preferably Mikroplast-PP 35-288-HX200-PP3.

The mechanical coupling means cover preferably between 20-100% of the entire surface of the coupling section, preferably between 20-80% and particularly preferably between 20-60%. In the case of additional adhesive coupling the proportion of the mechanical coupling means of the entire surface of the adhesive means can be smaller. The adhesive coupling means are preferably provide in a proportion of 10-60% of the entire surface of the coupling section, in particular of 30-60%. Further regions of the coupling section can be configured without adhesive means or in the form of the handling section.

The fastening section can be formed from a polymeric material, in particular polypropylene material, preferably from a non woven material, in particular a polypropylene non woven material. For permanent fixing of the fastening section on the body covering section, the surface of the fastening section which faces toward the body covering section is preferably provided with an adhesive means, in particular with a pressure sensitive adhesive, in particular a melt adhesive.

The release section can preferably be formed by a polypropylene film and the mechanical coupling means can also be made of polypropylene. The adhesive coupling means are preferably made of a melt adhesive.

The adhesive forces of the coupling section for the first closure element on the second closure element are preferably between 15 to 60 N, particularly 15 to 55 N, in particular 15 to 50 N, in particular between 15 to 45 N, further preferably between 20 to 45 N.

In particular, the coupling section has these adhesive forces on the outside of the body covering section or the material which forms the clothing item. In addition, the coupling section has preferably holding forces also on the material which forms the inside of the body covering section or the clothing item. The holding forces on the material which forms the inside allow providing the secondary function of the first closure element, namely the fixing of the clothing item in a rolled up or other state of reduced size for disposal.

Materials, such as film material, in particular also non woven materials have due to their manufacturing process directions, namely a machine direction (machine direction, MD) and an opposite direction (cross direction, CD) which is oriented perpendicular to the machine direction. The materials can have different properties, such as among others tear resistance in MD- and CD direction.

In particular, the first closure element and the material which forms the surface of the clothing item or the body covering section which material forms the mechanical coupling means of the second closure element are matched with each other so that the material which forms the second adhesive means is arranged with its machine direction (MD) in longitudinal direction of the first closure element and with this the coupling section (which is in particular understood as in transverse direction of the body covering section or the clothing item or oblique to the longitudinal and/or transverse direction).

In particular the holding forces of the fastening section of the first closure element on the second closure element are preferably between 15 to 60 N, in particular 15 to 55 N, in particular 15 to 50 N, in particular 15 to 45 N, further in particular 20 to 45 N, wherein in longitudinal direction of the first closure element or the coupling section, the material which forms the second closure element is arranged in its machine direction (MD).

Figure 8:
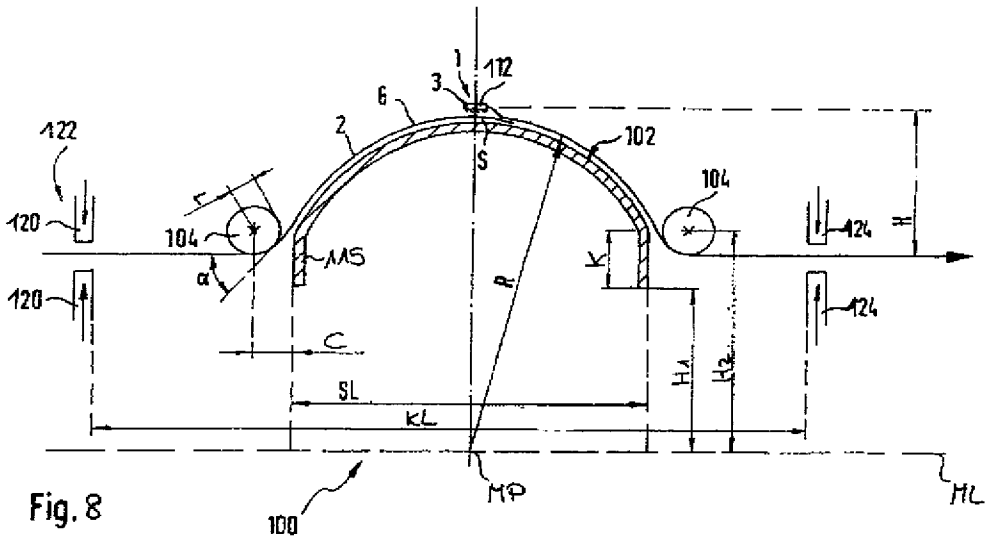

The adhesive forces are determined as follows:

In the formation of closures as described before, of medical clothing items on one hand a stable closure formation is to be achieved which also takes account of movement situations and which does not loosen unintentionally. On the other hand, the closure still has to be opened destruction free if desired and preferably also be re closable. In order to simulate the forces in test situations, which act on the closure systems it is known to perform tension tests in which the closure system is either exposed to peeling stress ("peeling", pulling angle=180°) or to shearing stress. The forces which during the performance of the tension test until release of the closure connection is recorded. As an alternative, in the method described in DE 10 2004053468A1 can be used which is here used and in which the test conditions are better reflect the actual wearing situation in order to increase the accuracy of the results yielded therein and their relevance. The two flat sections for the performance of the tension test are placed over an arched surface and subjected to tensile stress. The method is shown in FIGS. 8 and 9.

For performing the test method a tensile test device type Z010/TN 2S, measure dose 100 N, available from the company Zwick GmbH & Co KG, Ulm, Germany with a clamp jaw width for clamping the sample of 60 mm can be used. When performing the test method the closure system to be tested is placed with a loop forming component and a hook forming component which adheres to the loop forming component over an arched surface. For connecting the closure means with the clamp jaws of the tension test device, a ductile substrate, for example a one sided adhesive strip of a preferred length of 30 mm which is available from the company 3M Deutschland GmbH residing in Neuss under the name STA 306, is used. The adhesive band is made of polypropylene, its surface is coated by a urethane modified silicone polymer. The areal weight of the applied adhesive is 23 g/m$^2$. The sample which is placed over the arched surface and is formed by flat sections of the closure means which flat section adhere to one another, is subjected to tensile stress by using the tensile test device, which results in a shearing stress of the flat sections which adhere to one another.

Sample Preparation:

The mechanical closure means 1 to be used, i.e. the loop forming non woven material 2 and the hook forming component 3 of the closure system, are conditioned at 23° C. and 50% relative humidity over 24 h. Flat sections 6 of a size of 50×300 mm are punched out and are arranged or fixed sandwich-like between the ends 8 of two one-side adhesive bands 110 which are bonded against each other so that an overhang of the non woven material 2 of 50×250 mm results, i.e., the adhesive bands 110 overlap the non woven material 2 in longitudinal direction by $L_{kleb}$=50 mm. When the provided material has a smaller dimension to begin with it is fastened to the adhesive bands 110 so that an overlap results which allows a coverage of 30×50 mm with the hook forming component 3 of the closure means 1.

Figure 9A:
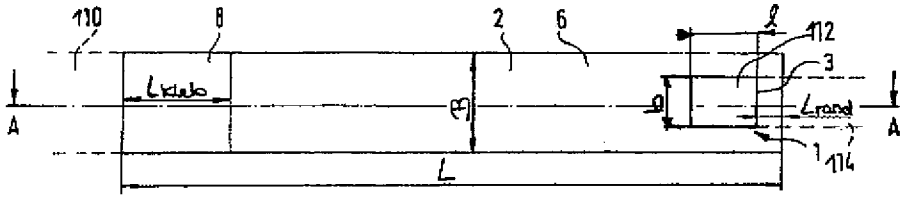
Figure 9B:
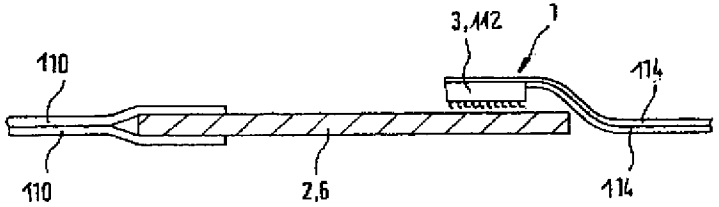

In the same manner, a flat section 112 of 30×50 mm is provided by the hook forming component 3 of the closure means 1, as shown in FIG. 9*a*, 9*b*. For this, the hook forming component 3 is fixed by two one-side adhesive tapes 114 which are bonded to one another with their adhesive surfaces thereby providing a flat section of 30×50 mm. The adhesive tapes 114 serve for extension for clamping in the tensile test device which is described in the following.

The flat section 112 of the hook forming component 3 (30×50 mm) is then placed on the section 6 of the loop forming non woven material 2, wherein the distance of the hook forming component 3 to the longitudinal edge of the non woven material is each 10 mm (cf FIG. 9*a*). The flat sections 6, 112 which are thus placed upon each other are connected by rolling over with a roller with a smooth surface and a rolling weight of 500 g, wherein the rolling speed is 20-100 mm/sec.

The component mentioned in the sample preparation corresponds in the clothing item according to the invention with the closure according to the invention to the second closure element 52 with second mechanical adhesion means, which are formed by a surface of the covering section. The mentioned component 3 corresponds to the coupling section 55 of the first closure element 51 with the first mechanical coupling means and as far as provided second adhesive coupling means.

Testing Method

The extended loop forming non woven material 2 described before is clamped into the lower clamping jaw 120 of the tensile test device 122 centered in the middle, and the opposing end of the extended hook forming component 3 as described before, is also clamped into the movable upper clamping jaw 124 of the tensile test device 122. If the loop forming non woven material is available in sufficient length an extension is not required.

Figure 10:
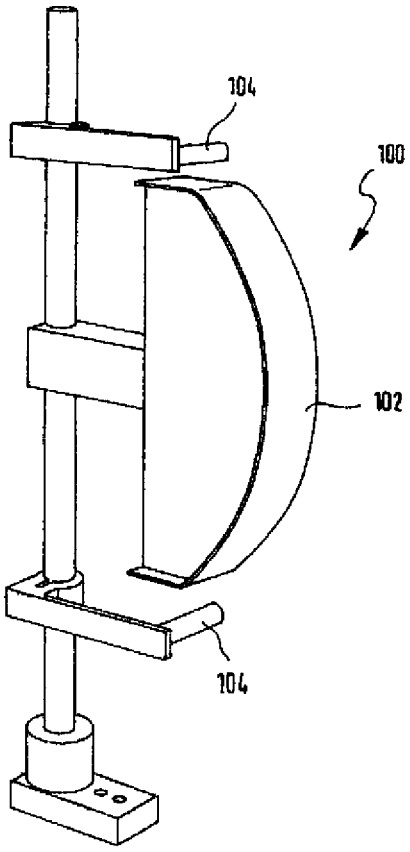

The thus clamped in sample is placed over the device 100 shown in FIG. 8 and FIG. 10, which is intended to simulate a bulged region of a user, as for example in the neck/neck region. A arched shaped area 102 can be seen which is made of polished steel with a rough depth of 5 to 25 μm and an arched angle R of at least in regions from 5 to 25 μm and with an curve radius R of at least in regions 400 mm and a chord length SL of 300 mm. Further measurements of the arch shaped curved area 102 is the variable dimension=56 mm, which designates the height of a non curved section 115, which adjoins the area 102 on both sides. Further, deflection rollers are provided above and below the curved area which deflect the test sample which is placed over the curved area in the vertical direction by H=88, where it is then connected with the clamping jaws 120, 124 of the not shown tensile test device. The clamping jaws 120, 124 have a distance KL=430 mm. The deflection rollers 104 have a radius r=18 mm. The distance of the deflection rollers from their respective center to the section 115 is C=27 mm. The lower free edge of the section 115 lies H1=274 mm over a line ML, which passes through the center MP of the area 102. The center of the deflection rollers 104 has a distance H2=330 to the center line ML. The deflection occurs about an angle a of 60°. Thereby, the pulling off angle is essentially tangential to the curved area 102 and is kept constant. The flat sections 6, 112 which are placed on to of each other of the components of the closure means 1 are positioned relative to the curved area 102 so that the hook forming component 3 comes to lie centered in the middle in the apex S of the curved area 102.

Then, the movable upper clamping jaw 124, with which the hook forming component is connected is move upward with the test speed stated below, and the pulling force acting between the clamping jaws during this is determined. The testing parameters are:

Testing speed: 300 mm/min

Clamping length of the test sample: 430 mm (cf FIG. 8 with reference sign KL)

Width of the sample and length of the first closure element: 30×50 mm (b×l)

Sample width and length of the second closure element: 50×300 mm (B×L)

Testing distance: distance until detachment of the coupling section from the second closure element Pre force: 0.2 N Number of tests: n>5

Testing device: Zwick Z010

Measuring head: 100 N (i.e., weight of max. 100 N possible)

The analysis is performed such that the maximal force which was determined until the detachment of the closure means from one another, is noted is rounded to two decimals in N (Newton) and is stated in the form of an average value of the n-tests and a maximal value.

In the case that the closure elements of the closure element materials have a preferred direction, the orientation is established which is expected during use or different directions are tested.

The present embodiment has the overall advantage that a secure closing of the opening of the body covering section in particular the neck region can be ensured at simultaneous secure protection of the closure prior to use in particular prior to coming into contact with skin or hairs of a wearer. It is particularly advantageous that the release section is not separated from the closure as is the case for further sections of the closure, which allows decreasing the generation of elements to be disposed and in particular limiting the risk that foreign bodies which stick to the coat such as for example an inadvertently not disposed release tape enter wounds.

In particular, the first closure element has a coupling section with a length of 3-8 cm, preferably of 4-6 cm, in particular of 4.5-5.5 cm, in particular about 5 cm and with a width of 1-5 cm, preferably of 2-4 cm in particular of 2.5-3.5 cm, in particular about 3 cm.

Particularly preferably, the coupling section is configured with first mechanical and second adhesive coupling means, wherein the mechanical coupling means are in particular arranged strip shaped transverse to the longitudinal direction of the coupling section with an extent in longitudinal direction of 2-5 mm, further in particular 2-4 mm, preferably multiple times and spaced apart, in particular 1-3 mm space apart. Particularly preferably, the first closure element with such a coupling section is disposed on a medical clothing item with a front side and a back side from two back parts, on or in the bordering region to the upper edge of a back part.

In the following, the invention is explained in more detail by way of a drawing.

Figure 2:
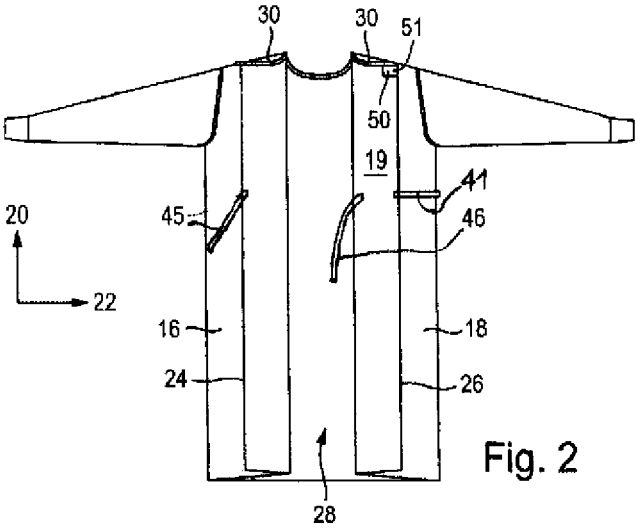
Figure 3:
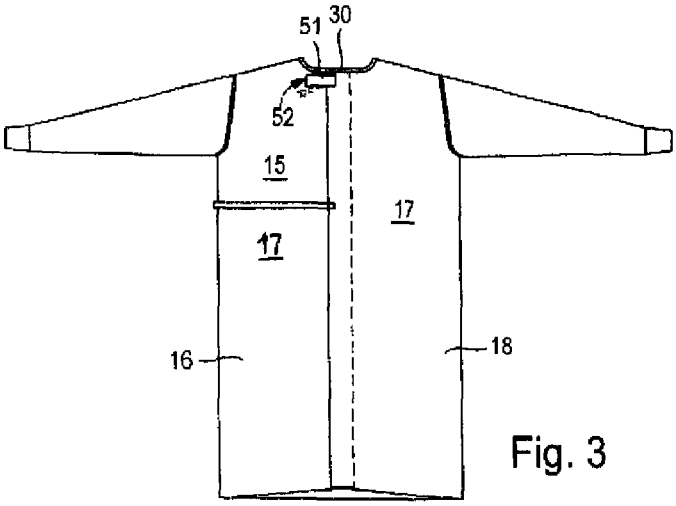
Figure 4:
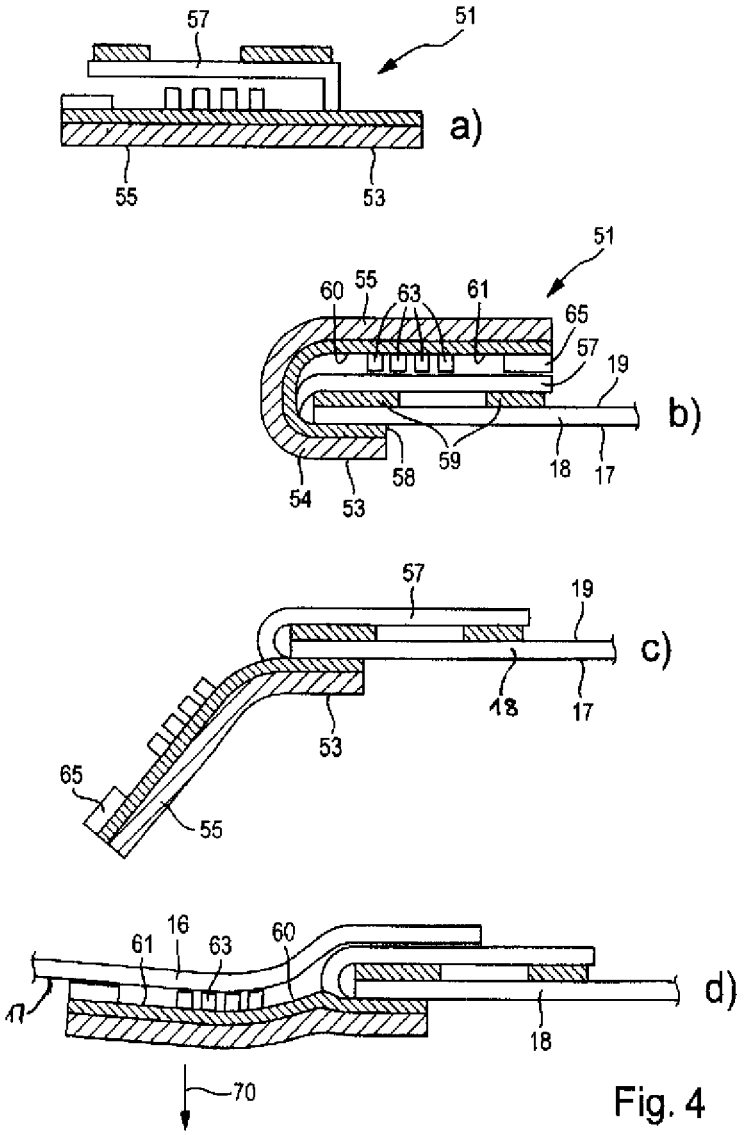
Figure 5:
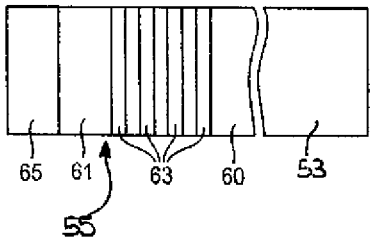
Figure 6:
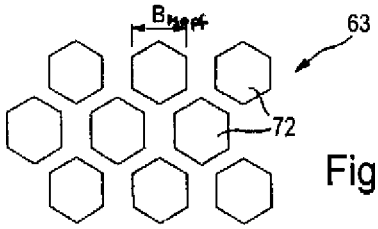
Figure 7:
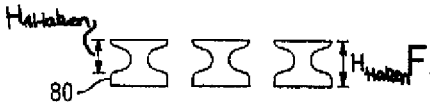

It is shown in:

FIG. 1 schematically a clothing item according to the invention from the front side;

FIG. 2 schematically a clothing item according to the invention in the open state from the backside;

FIG. 3 schematically a clothing item according to the invention rear side in the closed state;

FIG. 4 *a-d* schematically a first closure element, and its handling, and adhesion on the second closure element;

FIG. 5 schematically a representation of a coupling section of a first closure element in a top view;

FIG. 6 schematically a top view onto the mechanical coupling means of the first coupling section;

FIG. 7 schematically the mechanical coupling means in a side view;

FIG. 8 a schematic representation of the construction of a tensile testing method with a device with curve area;

FIGS. 9*a*, 9*b* schematic representation of the test sample and

FIG. 10 schematically a perspective view of a part of a device for performing a tensile test.

FIGS. 1 and 2 show a medical clothing item which overall is designated with the reference sign 10. The clothing item 10 includes a body covering section 12, which has a front part 14 and two back parts 16 and 18. The back parts 16 and 18 are connected to the front part in one piece. The back parts have essentially in longitudinal direction which is indicated with the reference sign 20 first and second side edges 24 and 26 which delimit an opening 28. The opening extends also essentially in longitudinal direction 20. The back parts 16 and 18 can later when worn overlap in regions in the transverse direction 22. Further the front part 14 and the back parts 16 and 18 include an upper edge 30, which in the worn state form the neck cutout. Further, two sleeves 32 are provided which are connected with the body covering section 12 with their proximal end and have cuffs 34 at their distal end.

In addition, FIG. 1 shows a part of a second closure in the form of a belt element 40, which part is formed by a band element 42 and a band element 41 which are fixed in a transfer card 44. The band element 41 is fixed on the side edges 26 of the back part 18 and the band element 42 is fixed on the front side 12. As clothing item fro wrapping and tying a further third closure formed by band elements 45 and 46 as shown in FIG. 2 is provided on the back side. The band elements 45 and 46 are fixed on the side edge 24 of the back part 16 and in a region on the inside 19 of the back part 18 which region is spaced apart from the side edge 26.

When the clothing item 10 is put on the wearer, the fixation occurs via two bands 45 and 46, which are connected to one another for example via a loop or a knot. Then a second person takes up the transfer card 44 with the band elements 41 while releasing the band elements 42. The transfer card 44 with the band element 41 is then guided around the wearer, by for example the wearer turning with the clothing item 10. Then the band element 41 is fixed with the band element 42 by tying the two band elements 41 and 42.

Further, the clothing item 10 includes a first closure 50 which is arranged on a side edge 26 on the back part 18 in the region of the upper edge 30, wherein a slight distance to the upper edge 30 can be provided. The closure 50 serves for connecting the side edges of the back parts 16 and 18 in the region of the neck cutout of a wearer. The closure 50 includes a first closure element 51 which in the non put on state extends on the inside 19 of the back part 18 and on its outside 17, which is shown in FIG. 3.

The closure 50 further has a second closure element 52, wherein the second closure element 52 is formed by a surface 15 namely the outside 17 of the back part 16. The first closure element 51 can be placed in the region of the upper edge 30 almost in any desired way on the surface 15, namely the outside 17 of the body covering section, whereby the second closure element 52 is formed.

In this way, an almost at will adjustability can be provided wherein at the same time by saving an additional separate landing component for the first closure element 51 no further material accumulations occur and with this a decreased flexibility and suppleness of the clothing item 10 in the neck region.

The first closure element 51 is now explained in more detail with reference to FIG. 4. FIG. 4 shows in a representation a) a first closure element 51 before it is fixed on an upper edge 30 of a clothing item 10. The first closure element 51 includes essentially three regions namely a fastening section 53, a coupling section 55 and a release section 57. Representation b) shows the closure element 51 as it is fixed in a non used state on a back part of a clothing item 10 according to FIG. 2. Again, the outside and the inside of the back part 18 of the clothing item 10 is designated 17 and 19. The fastening section 53 is fixed on the outside 17 of the back part 18 via an adhesive layer which is designated with the reference sign 58. The coupling section 55 is connected integrally and in one piece with the fastening section 53, which coupling section is fastened to the inside 19 of the back part 18, wherein the release section 57 is arranged between the surface 19 and the coupling section 55, which release section is adhesively connected with the surface 19 via two spaced apart adhesive surfaces 59. The release section 57 is a polypropylene film, on which the coupling section is detachably fastened via adhesive coupling means 60 and 61 which are also formed by a melt adhesive. The coupling section 55 and the fastening section 53 include as carrier material a non woven material 54 which forms the outward facing surface of the fastening section 53 and the coupling section. In addition first mechanical coupling means 63 are provided between the adhesive coupling means 60 and 61 which first mechanical coupling means 63 are configured as hook elements of a hook and loop fastening element. The mechanical coupling means 63 are applied strip shaped in the direction perpendicular to the drawing plane, as can be seen particularly well in FIG. 5. In addition the coupling section 55 includes a touch section 65 which is provided at the free end of the coupling section 55 and is made of a polypropylene a material in particular a polypropylene non woven material. In the region of the touch section 65 the coupling section 55 is not connected to the release section 57, i.e. is detachably fastened to the latter.

Besides the fastening of the coupling section 55 on the release section 57, the adhesive coupling means 60 and 61 also serve for supporting the fastening of the coupling section 55 on the second closure means, the surface 15 namely the outside 17 of the back part 16.

Representation c) shows the coupling section 55 which is detached from the release section 57, wherein the release section 57 remains adhering and non detachably fastened on the inside 19 of the back part 18 and the fastening section 53 remains non-detachably fastened on the outside of the back part 18. After the detachment of the coupling section 55 from the release section 57, a fastening occurs as shown in representation d) on the back part 16 on its outside 17, wherein for this the coupling section can be taken up via the holding element 65 and then be fastened on the back part 16 by means of the mechanical coupling elements 63 and the adhesive coupling elements 60 and 61. The different coupling elements serve different adhesive functions. For example, the mechanical coupling element 63 serves for securing against shearing off, wherein the mechanical coupling element is configured so as to adhere in the non woven material which forms the outside 17 of the clothing item 10, with its hooks. In addition, a further fastening occurs via the adhesive coupling means 60 and 61 which prevents a detachment of the closure element in the direction of the arrow 70 of the closure element 51.

The closure element 51, i.e. the coupling element 55 can after use serve for rolling up and fixing of the rolled up clothing item.

The mechanical coupling elements 63 are shown in sections in the plan view in FIG. 6 and have a hexagonal structure of the respective hook elements 72, wherein the hook elements 72 are arranged in rows which are offset with respect to each other inside the mechanical coupling elements 63. The hook elements can essentially have the following dimensions namely a diameter of the heads between two surfaces which is designated with the reference sign $B_{kopf}$, of 200 μm, and a height $H_{Haken}$ which is drawn in FIG. 7, of about 0.35 mm, wherein the distance between the socket 80 which serves for the fastening and the surface can be about 0.25 mm and is designated with the reference sign $H1_{Haken}$. Such coupling elements are available form the company Gottlieb Binder GmbH & Co. KG, Holzerlingen, Germany as the product Microplast PP.

The mechanical coupling elements 63 are made of a polypropylene material and are configured as hexagonal mushrooms with a density of 200-300 mushrooms/cm$^2$, in particular of about 288 mushrooms/cm$^2$.

The closure element 51 was tested with regard to its adhesive forces. Tested was a fixing of the coupling section on the inside and the outside of the non woven material. The non woven material was arranged with its machine direction ("machine direction (MD)") in the pulling direction of the testing method.

The testing was performed according to the previously described testing method.

The values resulting from this are listed in the following table. It can be seen that the outside of the non woven is different form the inside of the non woven.

TABLE 1

| | Non woven outside MD [N] | Non woven inside MD [N] |
|---|---|---|
| | 37.41 | 26.86 |
| | 38.64 | 32.68 |
| | 49.83 | 32.68 |
| | 51.68 | 30.72 |
| | 46.06 | 31.47 |
| Mean value | 44.72 | 30.89 |
| Standard deviation | 6.46 | 2.40 |
| Min value = | 37.47 | 26.86 |
| Max value = | 51.68 | 32.71 |

The present use of the closure in the described configuration has therefore the advantage that on one hand, the surface of the clothing item 10 can be used as second closure element and in particular the release section is not detached and thus there is no risk of this element for example entering a wound, because its disposal was forgotten. In particular no separate disposal is required.

The invention claimed is:

1. A medical clothing item, comprising:

a body covering section having an inside and an outside, and first and second side edges delimiting an opening of the body covering section for putting on the medical clothing item;

sleeves attached to the body covering section; and at least one closure for closing the opening, said closure comprising a first closure element arranged on the first side edge, and a second closure element, arranged on the second side edge and/or in a region bordering the second side edge, wherein the first closure element has a fastening section for permanent fastening on the body covering section, a release section non-detachably connected with the body covering section, and a coupling section connected with the fastening section, said coupling section being coverable by the release section when not interacting with the second closure element, wherein the coupling section has first mechanical coupling means for coupling to the second closure element wherein the second closure element has second mechanical coupling means formed by a surface of the medical clothing item, and wherein the first closure element has a substantially Y-shaped configuration, with the fastening section forming a lower end of the Y-shaped configuration and the release section and the coupling section forming respective upper ends of the Y-shaped configuration.

2. The medical clothing item of claim 1, wherein the medical clothing item is constructed as surgical gown or examination gown.

3. The medical clothing item of claim 1, wherein the first closure means is arranged on and/or bordering at an upper edge of the body covering section.

4. The medical clothing item of claim 1, wherein a first surface of the release section is non-detachably and permanently connected with the body covering section and a second surface of the release section is detachably covered by the coupling section.

5. The medical clothing item of claim 1, wherein the coupling section adjoins the fastening section in a longitudinal direction of the first closure element.

6. The medical clothing item of claim 1, wherein the first and second side edges overlappingly or confrontingly abut one another.

7. The medical clothing item of claim 6, wherein the first and second side edges come to lie in a region of a back of a wearer of the medical clothing item.

8. The medical clothing item of claim 1, wherein the fastening section is arranged on the outside of the body covering section and the release section is arranged on the inside of the body covering section.

9. The medical clothing item of claim 1, wherein the coupling section has a free end provided with a holding section.

10. The medical clothing item of claim 1, wherein the coupling section has second adhesive coupling means.

11. The medical clothing item of claim 10, wherein the first mechanical coupling means are arranged between the second adhesive coupling means in longitudinal direction of the coupling section.

12. The medical clothing of claim 1, wherein the first mechanical coupling means extend strip shaped and transverse to a longitudinal: direction of the coupling section.

13. The medical clothing item of claim 1, wherein the first mechanical coupling means are formed by a hook stalk and a hook head adjoining the hook stalk.

14. The medical clothing item of claim 1, wherein adhesive forces of the first closure element on the second closure element are between 15 and 60 N.

15. The medical clothing item of claim 14, wherein the adhesive forces are between 15 and 55 N.

16. The medical clothing item of claim 14, wherein the adhesive forces are between 15 and 50 N.

17. The medical clothing item of claim 14, wherein the adhesive forces are between 15 and 45 N.

18. The medical clothing item of claim 14, wherein the adhesive forces are between 20 and 45 N.

* * * * *